US010183775B2

(12) United States Patent
Sato et al.

(10) Patent No.: US 10,183,775 B2
(45) Date of Patent: Jan. 22, 2019

(54) STACKABLE BOXES

(71) Applicant: CCL Label, Inc., Framingham, MA (US)

(72) Inventors: Jay K. Sato, Mission Viejo, CA (US); Sriram Venkatasanthanam, Chino Hills, CA (US); Le-Hoa Hong, Temple City, CA (US); Stephen Li, Huntington Beach, CA (US); Eric Cushing, Riverside, CA (US); Mikael Darby, Brea, CA (US); Janice Valdez, Brea, CA (US)

(73) Assignee: CCL Label, Inc., Framingham, MA (US)

( * ) Notice: Subject to any disclaimer, the term of this patent is extended or adjusted under 35 U.S.C. 154(b) by 114 days.

(21) Appl. No.: 14/887,956

(22) Filed: Oct. 20, 2015

(65) Prior Publication Data

US 2016/0107785 A1 Apr. 21, 2016

Related U.S. Application Data

(60) Provisional application No. 62/066,053, filed on Oct. 20, 2014.

(51) Int. Cl.

| | |
|---|---|
| ***B65D 85/48*** | (2006.01) |
| ***B65D 5/38*** | (2006.01) |
| ***B65D 5/66*** | (2006.01) |
| ***B65D 5/72*** | (2006.01) |
| ***B65D 5/00*** | (2006.01) |
| ***B65D 5/22*** | (2006.01) |

(52) U.S. Cl.

CPC ..... *B65D 5/38* (2013.01); *B65D 5/0015* (2013.01); *B65D 5/22* (2013.01); *B65D 5/6664* (2013.01); *B65D 5/721* (2013.01)

(58) Field of Classification Search

CPC ..... B65D 5/38; B65D 5/0015; B65D 5/20; B65D 5/22; B65D 5/6664; B65D 5/721; B65D 5/728; B65D 7/10; B65D 9/08; B65D 11/12

USPC ..... 206/449, 127, 750, 499, 503–513; 229/185.1, 190, 147, 151, 100, 750, 913, 229/125.12, 125.125, 122, 129.1, 220

See application file for complete search history.

(56) References Cited

U.S. PATENT DOCUMENTS 3,112,058 A * 11/1963 Martin ..... B65D 5/22 206/445

3,114,493 A 12/1963 Dunkin (Continued)

*Primary Examiner* — J. Gregory Pickett
*Assistant Examiner* — Rafael Ortiz
(74) *Attorney, Agent, or Firm* — McDonald Hopkins LLC

(57) ABSTRACT

A stackable container as shown and described herein. The stackable container may include an outer container having a bottom panel, a pair of opposite side walls and an end wall that extend from the bottom panel respectively. Said bottom panel may have at least one slot. A plurality of locking tabs may extend downward through said slots and a top panel may extend from the end wall wherein the top panel may be adapted to be pivoted between an open position and a closed position a front panel may extend from the bottom panel may be adapted pivot between an open position and a closed position. An inner container may be configured to be slidingly received within the outer container when the front panel is in the open position.

19 Claims, 8 Drawing Sheets

(56) References Cited

U.S. PATENT DOCUMENTS

| | | | | |
|---|---|---|---|---|
| 4,291,830 | A * | 9/1981 | Sorensen | B65D 5/003 206/509 |
| 6,170,663 | B1 * | 1/2001 | Glassman | B65D 75/32 206/461 |
| 8,387,856 | B1 * | 3/2013 | Lachance | B65D 5/6655 206/738 |

* cited by examiner

STACKABLE BOXES

CROSS-REFERENCE TO RELATED APPLICATIONS

This application claims priority to U.S. provisional patent application No. 62/066,053 filed on Oct. 20, 2014 titled STACKABLE BOXES which is incorporated by reference in its entirety.

FIELD OF INVENTION

The present disclosure generally relates to a container apparatus for transporting and stacking documents wherein the container apparatus is configured to store and transport media therein. More particularly, the present disclosure relates to shipping containers, such as are used for the shipping of media, in particular to stackable shipping containers fabricated from paper, paperboard, corrugated paperboard and/or any appropriate material.

BACKGROUND

Corrugated paperboard is typically used in many different applications, for example, to form containers, boxes, cartons, or dividers for holding, storing, stacking or shipping various articles.

Typically, corrugated containers have a bottom and four side walls, and are formed from a blank that scored with fold lines or cut lines. Optionally, the container may include a top made from a separate blank for covering the opening of the container. The blanks are most often formed by automated machines in a continuous in-line process involving cutting, scoring, and molding continuous sheets of cardboard or paperboard. The paperboard may then be folded along the score lines or cut lines to form a container. The blanks may be folded into a container by an automated machine or by a consumer. Containers, fabricated in whole or in part, from paper, paperboard, cardboard, and corrugated paperboard, are employed for the shipping and storage of a variety of articles. One such category of article is printable media. Printable media may be generally shipped and stored in containers. Many shipping container designs that utilize cardboard materials require an arrangement that can securely transport the articles within the container while reducing the risk of damaging the articles therein.

Many contemporary designs have variations of containers having an interlocking and stackable arrangement with an open-top having a removable lid such as the features disclosed by Dunkin in U.S. Pat. No. 3,114,493. These containers are formed from one-piece blanks of corrugated material and function to prevent removal of the contents within the container during shipment and storage.

However, the containers of the prior art each have a problem in utilization that makes it relatively unattractive to manufacture or use. For example, a container with stacked containers positioned above requires that the stacked containers be removed in order for a user to remove the top or cover and access the articles therein. Some require complicated procedures to assemble the container. Others require fasteners such as staples or glue for assembly, which in addition to higher costs, make it difficult to disassemble the container for storage and re-use without damaging the container.

Accordingly, it is an object of the present disclosure to provide a cost-efficient container that is easy to assemble and disassemble and which has multiple features that allow it to be easily stacked with other containers to form a container stack that is stable and which minimizes damages to the containers in the stack. It is also an object to the present disclosure to provide a container that provides quick and easy access to its contents while it may be maintained in a stackable arrangement while generally protecting the contents thereof.

These and other desirable characteristics of the disclosure will become apparent in light of the present specification, including claims, and figures.

SUMMARY

A stackable container as shown and described herein. The stackable container may include an outer container having a bottom panel, a pair of opposite side walls and an end wall that extend from the bottom panel, respectively. The side walls may each include an outer side wall panel and an inner side wall panel. The inner side all panels may be attached at an upper edge to an upper edge of said outer panel. Said bottom panel may have at least one slot extending therethrough approximately positioned by a plane of said inner side wall panels. A plurality of locking tabs may attach to a lower edge of said inner end wall panels. The locking tabs may extend downward through said slots and approximately conform to said slots. A top panel may extend from an upper edge of the end wall. A pair of side flap panels may extend from opposite edges of the top panel wherein the top panel may be adapted to be pivoted between an open position and a closed position such that the side panels may be positioned inwardly relative to the side walls in the closed position. A front panel may extend from the bottom panel and include a pair of hinge flaps that extend from opposite edges of the front panel. The front panel may be adapted pivot between an open position and a closed position. An inner container may be configured to be slidingly received within the outer container when the front panel is in the open position.

In embodiment, the inner container may be configured to retain at least one article therein as the inner container is slidingly received within the outer container. The at least one article may a printable media or a stack of printable media.

In one embodiment, the inner container may further include a bottom panel, a pair of opposite side walls and a pair of opposite end walls that may extend from the bottom panel respectively. The side wall and end walls may each include an outer panel and an inner panel. The inner panels may be attached to an upper edge of said outer panel. Said bottom panel may have slots extending therethrough that may be approximately positioned by a plane of said inner end wall panels and approximately positioned by a plane of inner side wall panels, respectively. A plurality of locking tabs may approximately conform to said slots and may extend from lower edges of said inner end wall panels and the lower edges of said inner side wall panels. The locking tabs may extend downward through said slots.

In another embodiment, the pair of side flap panels that extend from the front panel of the outer container may be positioned between the inner side wall panel and the outer side wall panel of the outer container when the front panel is in the closed position. Further, in another embodiment, the locking tabs may have a dimension that is greater than a thickness of said bottom panel such that the locking tabs project a distance through the bottom panel. The locking tabs may be adapted to fit into an area of a similar and sub-adjacent container for restraining the outer container against relative movement. The outer container and the inner container may be formed from a one piece blank of foldable sheet material. The outer container may further include a font flap that extends from the top panel and at least one double-locking tab.

The stackable container provided may further include an outer container having a bottom panel, a pair of opposite side walls, a plurality of locking tabs. The outer container further including a top panel operably attached to the bottom panel wherein the top panel may be adapted to be pivoted between an open position and a closed position. A front panel may be attached to either the top panel or the bottom panel and be adapted to be pivoted between an open position and a closed position. The stackable container may further include an inner container configured be slidingly received within the outer container when the front panel is in the open position.

BRIEF DESCRIPTION OF THE DRAWINGS

Operation of the disclosure may be better understood by reference to the following detailed description taken in connection with the following illustrations, wherein.

DETAILED DESCRIPTION

Reference will now be made in detail to embodiments of the present disclosure, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the disclosure.

Figure 1:
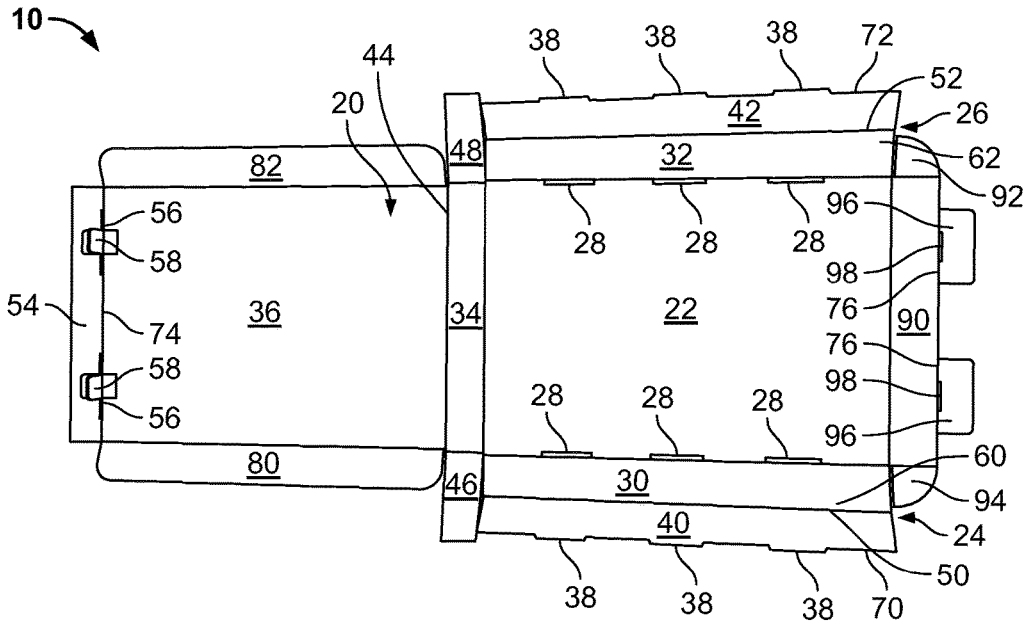
FIG. 1 is a top view of an embodiment of an unfolded blank from which an outer container of a stackable container apparatus is constructed in accordance with the present disclosure.
Figure 2:
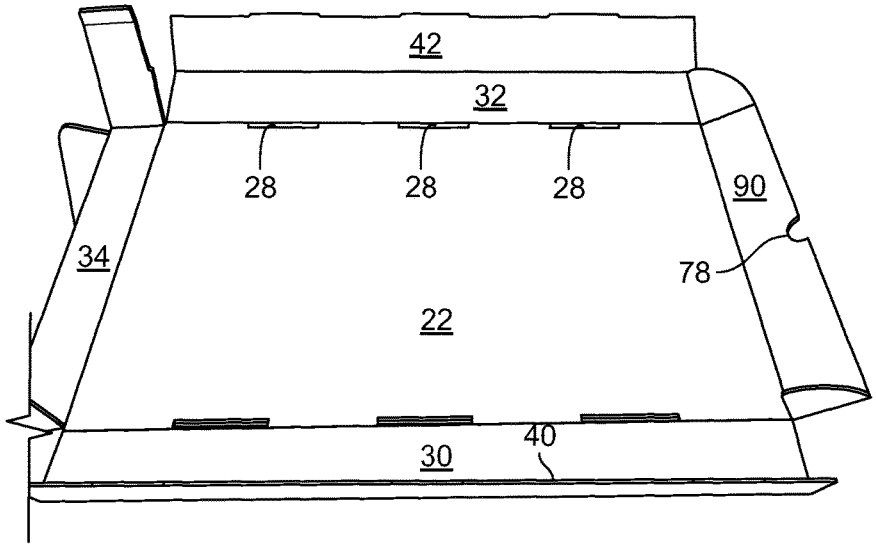
FIG. 2 is a side perspective view of a portion of the unfolded blank of FIG. 1.

Illustrated by FIGS. 1 and 2 is an outer container 20 for a stackable container apparatus. The outer container 20 may be formed of a blank 10 that is cut from a generally planar stock material such as, for example, corrugated cardboard material or plastic. However, the embodiments of the stackable container apparatus may be made from any suitable material which can be cut and folded, but preferably made from paperboard or corrugated cardboard stock. The container is structured such that a cut and scored blank may be manufactured from the planar stock material, and the container may be constructed by folding the various panels, flaps, tabs, and walls in a prescribed manner. The resulting container is self-maintaining and may be constructed without adhesives or other mechanical fasteners. The blanks may be cut such that corrugation flutes are arranged to run lengthwise or longitudinal relative to the blank material.

Figure 3:
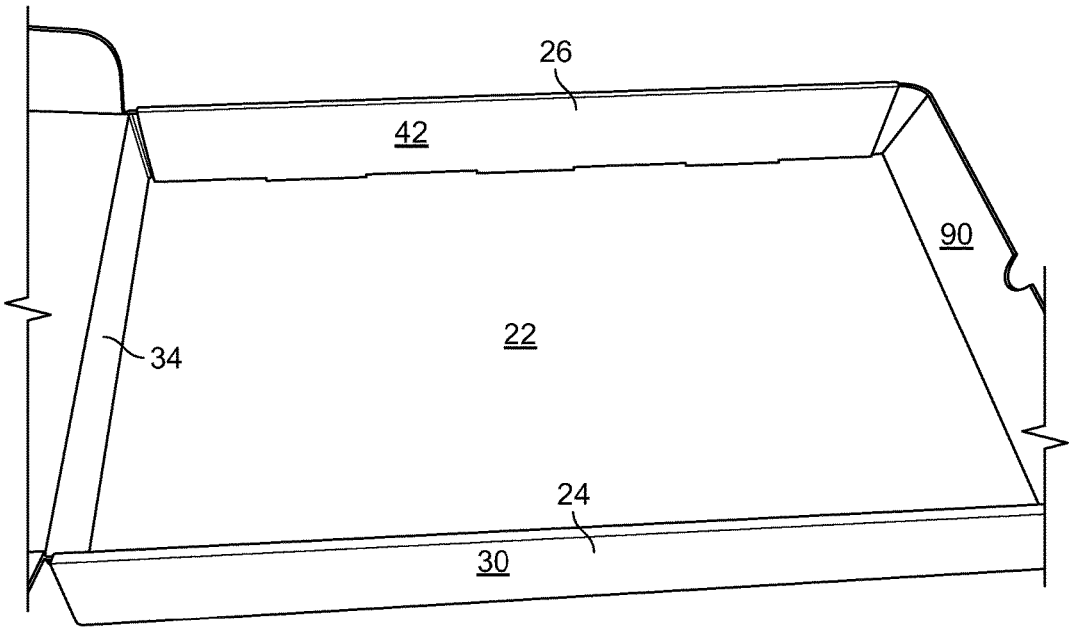
FIG. 3 is a perspective view of a folded blank of the outer container of FIG. 2.

FIGS. 1 and 2 illustrate the blank 10 of the outer container 20 in an unfolded state. FIG. 3 illustrates the blank 10 constructed into a folded state. The blank 10 may be cut completely through to form longitudinal slits, lateral slits, and tabs. The blank may be scored to form fold lines and foldable panels. The cuts and scores in the blank 10 may be constructed to form the outer container 20. The outer container 20 may include a bottom panel 22, a pair of opposite side walls 24, 26 and an end wall 34 that extend from the bottom panel 22. The side walls 24, 26 each may include an outer side wall panel 30, 32 and an inner side wall panel 40, 42. The inner side wall panels 40, 42 may be attached at an upper edge 50, 52 to an upper edge 60, 62 of said outer side wall panel 30, 32, respectively. The bottom panel 22 may include a plurality of slots 28 extending therethrough. The slots 28 may be aligned to be approximately positioned by a plane of inner side wall panels 40, 42 as the blank 10 is constructed into the outer container 20.

A plurality of locking tabs 38 may extend from or be attached to a lower edge 70, 72 of the inner side wall panels 40, 42, respectively. When the inner side wall panels 40, 42 are folded against the outer side wall panels 30, 32, the locking tabs 38 may be aligned and positioned to extend downward through the slots 28. The locking tabs 38 may be configured to conform within the slots 28. The locking tabs 38 may be aligned with the plane of the inner side wall panels 40, 42 to allow general alignment with the slots 28 as the side walls 24, 26 are positioned in a general perpendicular orientation relative to the bottom panel 22. When the outer container 20 is positioned in a stacked arrangement with another similar and sub-adjacent stackable container, the locking tabs 38 may extend past the bottom panel 22 to at least partially engage an area of the other stacked outer container as will be discussed in more detail below.

A top panel 36 may extend from an upper edge 44 of the end wall 34. The end wall 34 may include a pair of support panels 46, 48 that extend from the opposite edges of the end wall 34. The support panels 46, 48 may be configured to be positioned between the outer side wall panels 30, 32 and the inner side wall panels 40, 42, respectively, when the blank 10 is constructed into the outer container 20. The support panels 46, 48 may stabilize the container and prevent unintended bending or opening in a sideways manner. This may provide additional protection for the items held therein.

A pair of side flap panels 80, 82 may extend from opposite edges of the top panel 36 wherein the top panel 36 may be adapted to be pivoted between an open position and a closed position when the blank 10 is constructed into the outer container 20. The side flap panels 80, 82 may be positioned inwardly relative to the side walls 24, 26 in the closed position. A front flap 54 may extend from the top panel 36 at a position opposite from the end wall 34. The front flap 54 may include at least one lateral slot 56 positioned adjacent to a fold or tear line 74 between the front flap 54 and the top panel 36. At least one tab 58 may be formed from the front flap 54 and top panel 36 having a crease in general alignment with the lateral slot 56. In one embodiment, the outer container 20 may include two lateral slots 56 and two tabs 58. The front flap 54 and tabs 58 may be operably connectable to the outer container 20 and will be described in more detail below. Additionally, the front flap 54 and tabs 58 may be removed from the top panel 36 along the fold or tear line 74 as desired by a user.

A front panel 90 may extend from the bottom panel 22 opposite from the end wall 34. The front panel 90 may include a pair of hinge flaps 92, 94 that may extend from opposite edges of the front panel 90. The front panel 90 may be adapted to be pivoted between an open position and a closed position when the blank 10 is constructed into the outer container 20. As the front panel 90 is pivoted, the hinge flaps 92, 94 may be configurable to be positioned between the outer side wall panels 30, 32 and the inner side wall panels 40, 42, respectively, when the blank 10 is constructed into the outer container 20. At least one tab 96 may extend from the front panel 90 opposite from the bottom panel 22. The tab 96 may include a lateral slot 98 generally aligned along a fold or tear line 76. The lateral slot 98 may be configured to receive the tab 58 from the front flap 54 while the lateral slot 56 may be configured to receive the tab 96 that extends from the front panel 90. This configuration may be referred to as a double-locking tab. In this embodiment, the outer container 20 may be in a locked position as the top panel 36 is in the closed position and the front panel 90 is in the closed position. While a double-locking tab is shown and described, any number of locking tabs may be used without departing from the present teachings.

Figure 13:
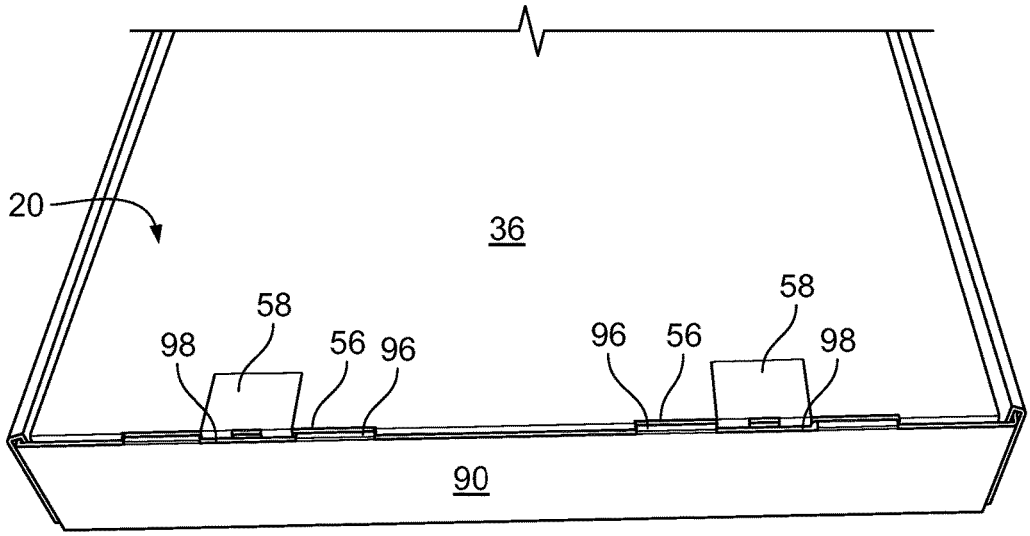
FIG. 13 is a front perspective view of a top panel of the outer container in a closed position and the front panel of the outer container in a closed position.
Figure 14:
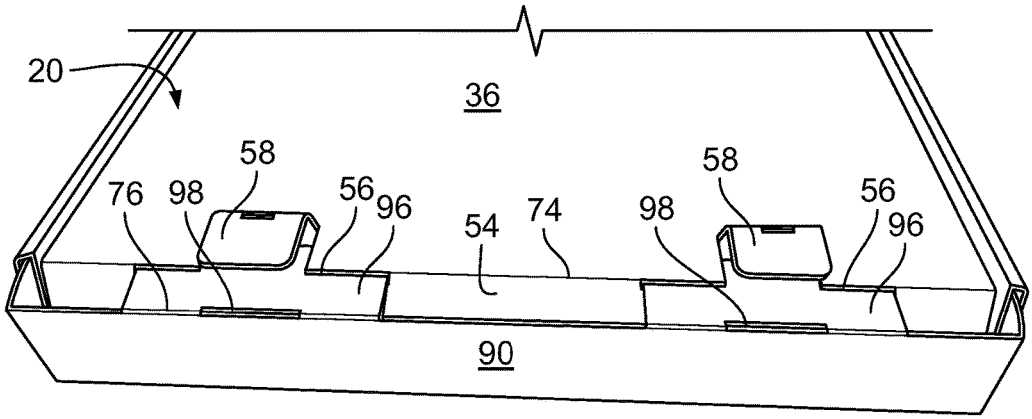
FIG. 14 is a front perspective view of the top panel of the outer container in the closed position and the front panel of the outer container in an unlocked position.

The outer container 20 is illustrated in the locked position in FIG. 13 and the unlocked position in FIG. 14. In embodiments of the present disclosure, any number of tabs 58, 96 and lateral slots 98, 56, may be aligned between the top panel 36, front flap 54, and the front panel 90 to securely close the container during shipment or storage and to keep its contents from sliding out. Additionally, a portion of the tabs 58 and the front flap 54 may be removed from the top panel 36 along the fold or tear line 74 and the tabs 96 may be removed from the front panel 90 along the fold or tear line 76 as desired by a user as illustrated by FIG. 2. The user may do so to create a "drawer-like" effect for the contents as described in more detail below. Additionally, a ledge 78 (FIG. 2) may be formed along the front panel to allow the user to grasp and pivot the front panel 90 between the closed and open position. The front panel 90 may be pivoted between the open position and the closed position when the tabs 58 and 96 are not received within the slots 98, 56, respectively. Additionally, the front panel 90 may be pivoted between the open position and the closed position when the top panel 36 is in either the closed position or the open position.

As the blank 10 is constructed into the outer container 20, the bottom panel 22, side walls 24, 26, end wall 34 define an area configured to receive an inner container 120 therein while the top panel 36 and front panel 90 may each be pivoted between the open position and the closed position generally independent from one another.

The inner container 120 may be formed of a blank 100 that is cut from a generally planar stock material such as, for example, corrugated cardboard material. However, the embodiments of the inner container 120 may be made from any suitable material such as plastic which can be cut and folded, but preferably made from paperboard or corrugated cardboard stock. The container 120 is structured such that a cut and scored blank may be manufactured from the planar stock material, and the container 120 may be constructed by folding the various panels, flaps, tabs, and walls in a prescribed manner—the blank 100 may be monolithically formed. The resulting container is self-maintaining and may be constructed without adhesives or other mechanical fasteners. The blank 100 may be cut such that the corrugation flutes are arranged to run lengthwise or longitudinal relative to the blank material.

Figure 4:
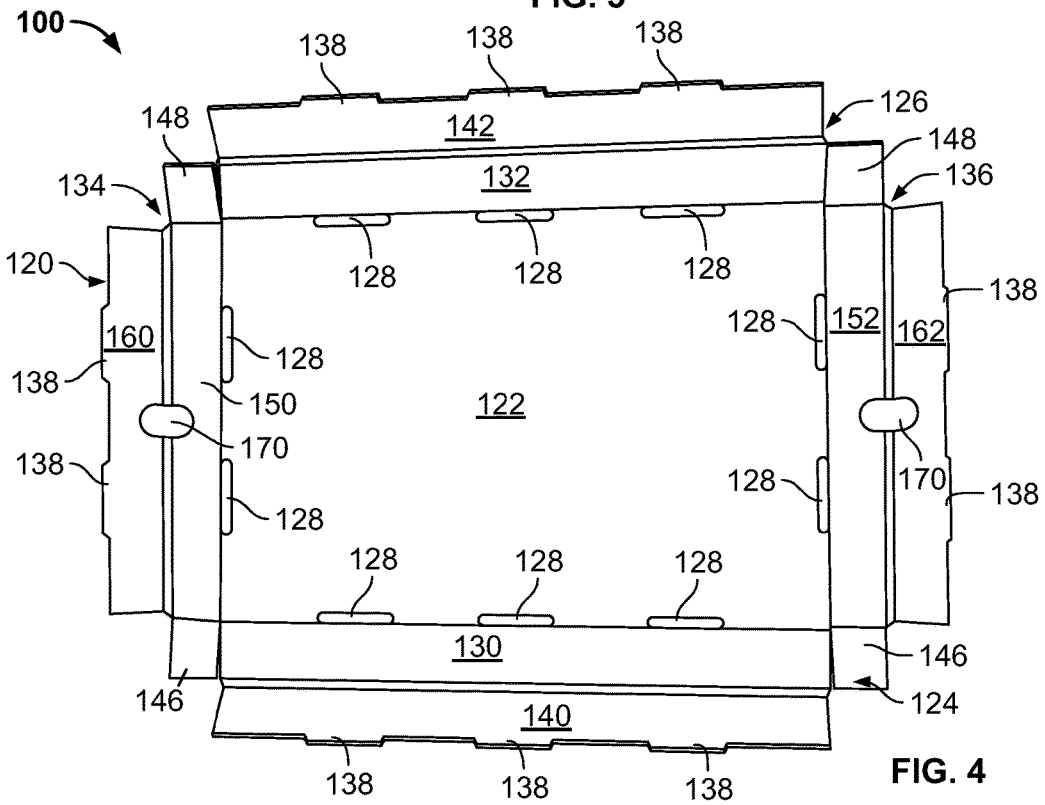
FIG. 4 is a top view of an unfolded blank of an inner container from which the outer container of a stackable container apparatus is constructed in accordance with the present disclosure.
Figure 5:
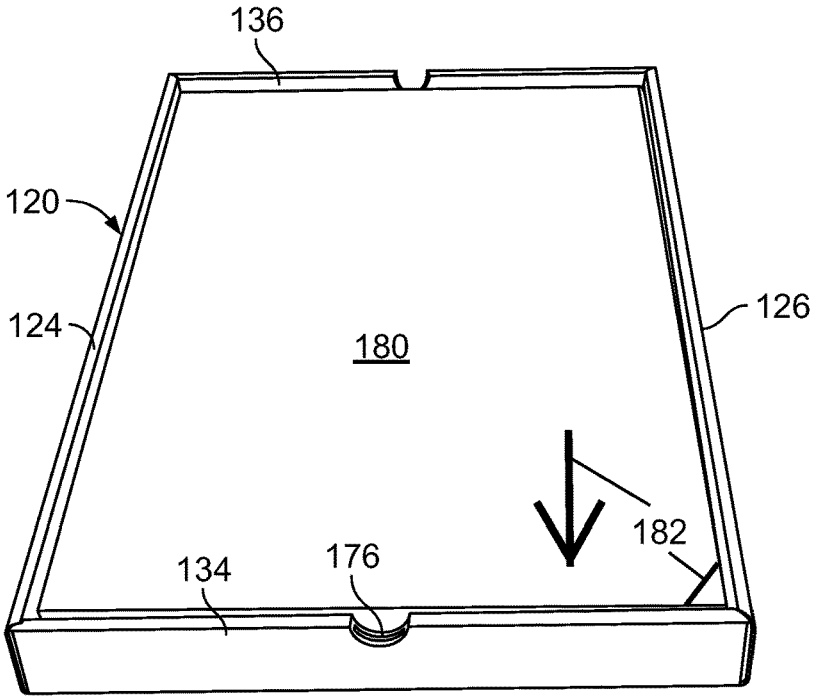
FIG. 5 is a front perspective view of a folded blank the inner container of FIG. 4 with media therein in accordance with the present disclosure.

FIG. 4 illustrates the blank 100 of the inner container 120 in an unfolded state. FIG. 5 illustrates the blank 100 constructed into a folded state having a stack of media 180 retained therein. The blank 100 may be cut completely through to form longitudinal slits, lateral slits, and tabs. The blank may be scored to form fold lines and foldable panels. The cuts and scores in the blank 100 may be constructed to form the inner container 120. In an embodiment, the inner container 120 may be made of corrugated cardboard material or plastic and be generally constructed to retain printable media 180 as illustrated by FIG. 5.

In one embodiment the media 180 retained within the inner container may include a visual cue 182 to indicate various information to the user. The visual cue may include a cut corner of the media or indicia printed thereon to indicate to the user the operative direction of the media as it relates to a processing direction. Also, the visual cue would help the user to quickly retrieve and return media 180 into the container in the proper relative orientation as needed.

As illustrated by FIG. 4, the inner container 120 may include a bottom panel 122, a pair of opposite side walls 124, 126 and a pair of opposite end walls 134, 136 that extend from the bottom panel 122. The side walls 124, 126 each may include an outer side wall panel 130, 132 and an inner side wall panel 140, 142. The inner side wall panels 140, 142 may be attached at an upper edge to an upper edge of said outer side wall panels 130, 132, respectively. The end walls 134, 136 each may include an outer end wall panel 150, 152 and an inner end wall panel 160, 162. The inner end wall panels 150, 152 may be attached at an upper edge to an upper edge of said outer end wall panels 160, 162, respectively.

The bottom panel 122 may include a plurality of slots 128 extending therethrough. The slots 128 may be longitudinal and lateral. The longitudinal slots 128 may be aligned to be approximately positioned along a plane of inner side wall panels 140, 142 and the lateral slots 128 may be aligned to be approximately positioned along a plane of inner end wall panels 150, 152 as the blank 100 is constructed into the inner container 120.

A plurality of locking tabs 138 may extend from or may be attached to a lower edge of the inner side wall panels 140, 142 and a lower edge of the inner end wall panels 160, 162. The locking tabs 138 may extend downward through the slots 128 and be configured to conform within the slots 128.

The outer end wall panels 150, 152 may include a pair of opposing support panels 146, 148 that extend from the opposite edges of the outer end wall panels 150, 152. The support panels 146, 148 may be configurable to be positioned between the outer side wall panels 130, 132 and the inner side wall panels 140, 142, respectively, when the blank 100 is constructed into the inner container 120. Optionally, the support panels 146, 148 may extend from opposite edges of the outer side wall panels 130, 132 to be positioned between the outer end wall panels 150, 152 and the inner end wall panels 160, 162, respectively, when the blank 100 is constructed into the inner container 120.

The bottom panel 122, side walls 124, 126 and end walls 134, 134 may define an area configured to retain at least one article therein. For example, that article may be at least one sheet of printable media 180 and preferably the area defined by the inner container 120 may retain an entire stack of printable media to be protected during shipment or storage.

At least one aperture 170 may be cut through the score line between the outer end walls 150, 152 and the inner end walls 160, 162. Once the inner end walls 160, 162 are folded along the score lines shared with the outer end walls 150, 152, the apertures 170 may form a ledge 176 that allows a user to grasp and slidingly position the inner container 120 relative to the outer container 20. Optionally, at least one ledge 176 may be provided along the side walls 124, 126 and the end walls 134, 136. Further still, the apertures 170 may allow a user to visually identify the amount of media contained within the container 120. Therefore, the user may not need to remove the inner container 120 from the outer container 20 to identify the inventory level of the media. Additionally, the user may not need to open the top panel 36 of the outer container 20 to identify the inventory level of the media.

Figure 6:
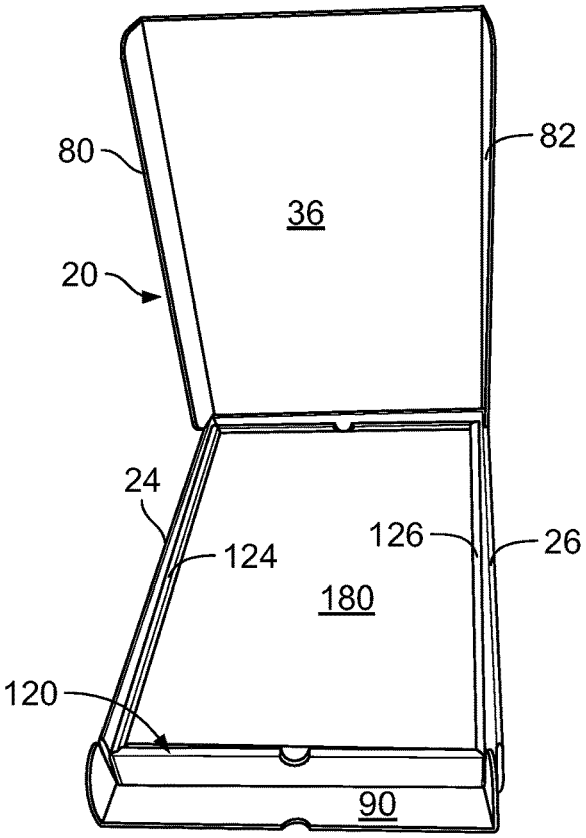
FIG. 6 is a front perspective view of an embodiment of the outer container with a top panel in an open position with the inner container and media therein in accordance with the present disclosure.

As illustrated by FIG. 6, the area defined by the outer container 20 is configured to receive the inner container 120 therein. The side walls 124, 126 of the inner container 120 may be inwardly positioned relative to the side walls 24, 26 of the outer container 20 and define a space therebetween. The side flap panels 80, 82 of the top panel 36 may be operably positioned between the side walls 124, 126 of the inner container 120 and the side walls 24, 26 of the outer container 20 when the top panel 36 is in the closed position. The side flap panels 80, 82 may have generally rounded edges to reduce the risk of unintended bending or creasing of the panels as they are positioned between the side walls 24, 26, 124, 126.

Figure 7:
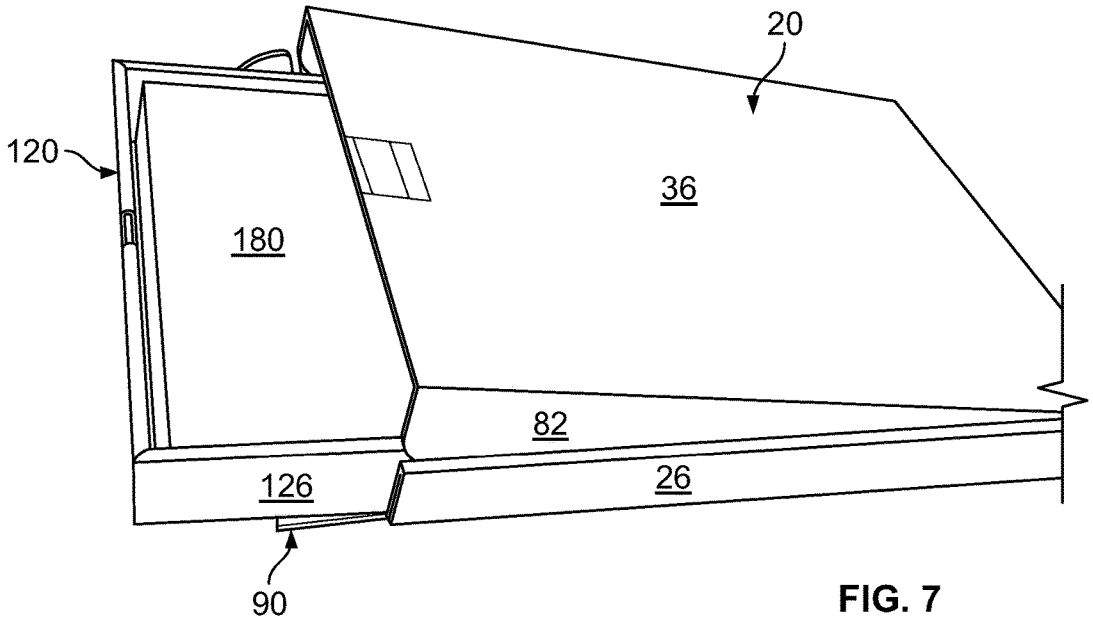
FIG. 7 is a side perspective view of an embodiment of the inner container partially within the outer container in accordance with the present disclosure.

FIG. 7 illustrates the inner container 120 partially within the outer container 20 in accordance with an aspect of the present disclosure. The front panel 90 may be pivoted to the open position such that the inner container 120 may slide outwardly from within the outer container 20. This drawer feature may allow the user to easily access the media or articles contained within the inner container 120 without having the open the top panel 36 of the outer container 20. This feature allows the user to access the articles quickly as they are maintained in storage while also being protected for future use.

As illustrated by FIG. 7, the top panel 36 of the outer container 20 is slightly open such that the side slaps 80, 82 are partially positioned between the side walls 124, 126 of the inner container 120 and the side walls 24, 26 of the outer container 20 while allowing a hand of a user to grasp the inner container 120 or the media retained therein. In this slightly open position, additional outer containers 20 may be supported or maintained in a stacked orientation above the instant container while the top panel 36 is at least partially in the open position. Alternatively, the top panel 36 of the outer container 20 may be closed such that the side slaps 80, 82 are positioned between the side walls 124, 126 of the inner container 120 and the side walls 24, 26 of the outer container 20. In this orientation, a hand of a user may grasp the inner container 120 or the media retained therein. In this position, additional outer containers 20 may be supported or maintained in a stacked orientation above the instant container while the top panel 36 is in a generally closed position.

Figure 8:
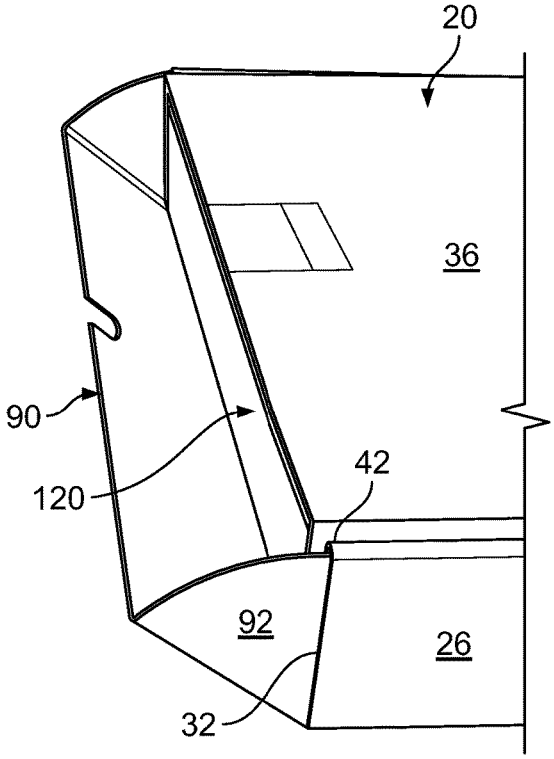
FIG. 8 is a side perspective view of an embodiment of the inner container positioned within the outer container and a front panel positioned in an open position in accordance with the present disclosure.
Figure 9:
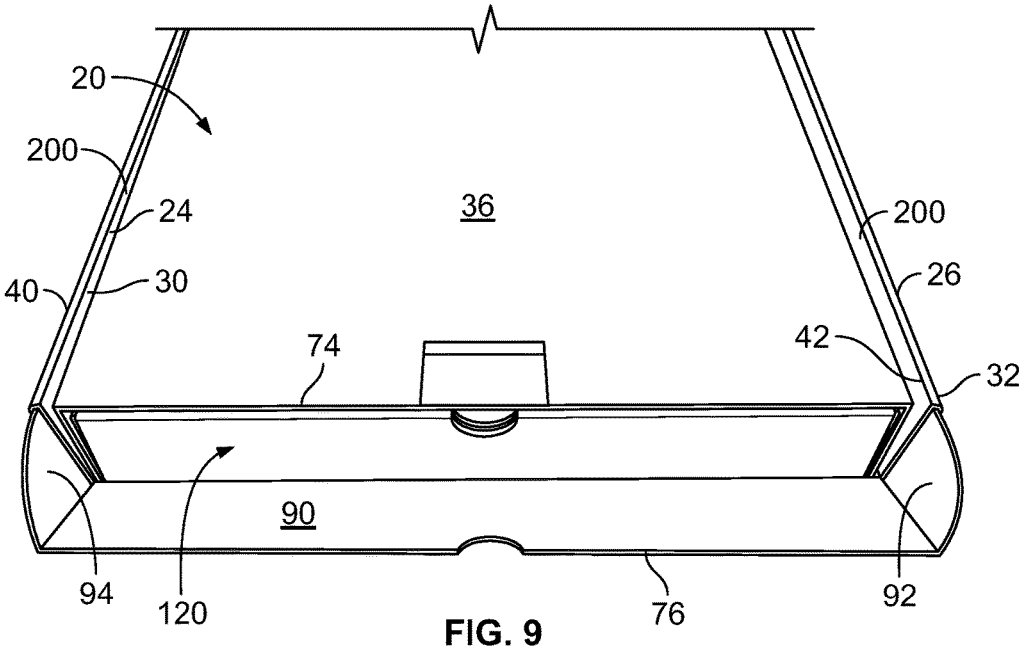
FIG. 9 is a front perspective view of an embodiment of the inner container positioned within the outer container and a front panel positioned in an open position in accordance with the present disclosure.

FIGS. 8 and 9 show the inner container 120 positioned within the outer container 20 as the top panel 36 is in the closed position and the front panel is pivoted in a partially open position. As the front panel 90 is pivoted, the hinge flap 94 may be movably positioned between the outer side wall panel 32 and the inner side wall panel 42 of the side wall 26 of the outer container 20. Similarly, the hinge flap 92 may be movably positioned between the outer side wall panel 30 and the inner side wall panel 40 of the side wall 24 of the outer container 20. The hinge flaps 92, 94 may assist to securely keep the front panel in the closed position during transport or storage. FIGS. 8 and 9 additionally illustrate an embodiment wherein the front flap 54 and tabs 58 are removed from the top panel 36 along the fold or tear line 74 and the tabs 96 are removed from the front panel 36 along the fold or tear line 76 as desired by a user. In this orientation, the user may slide the inner container 120 from the outer container 20 such that the inner container 120 may act as a drawer. This may allow the user to access the media (such as the labels contained therein) while a plurality of containers 20 (120) may be stacked on top of each other. The user then needs not to remove the stacked containers to access the media therein.

Figure 10:
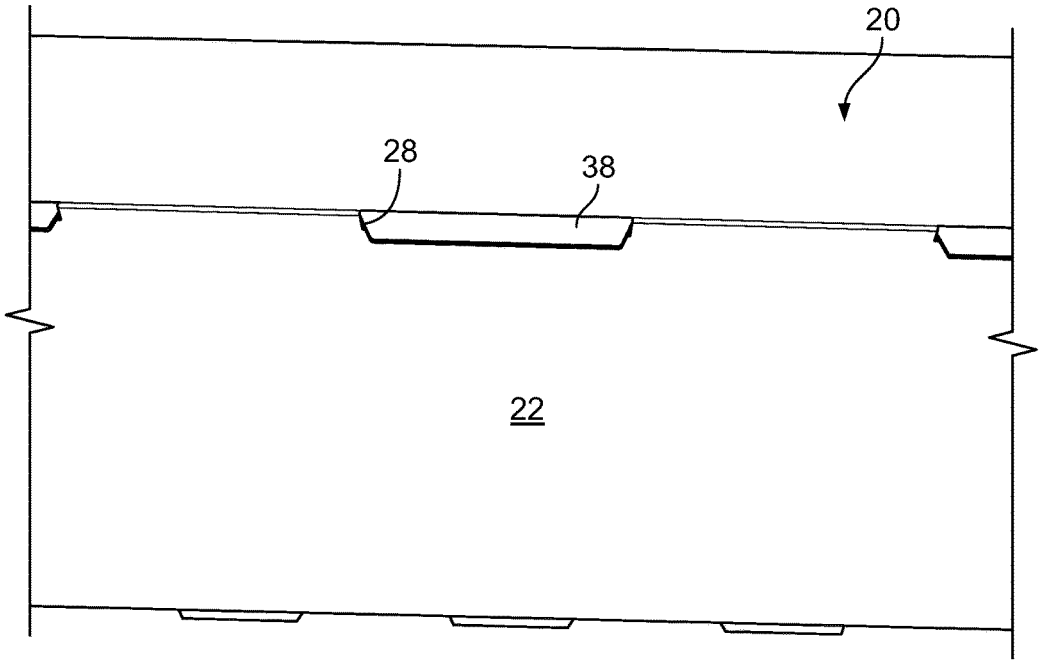
FIG. 10 is a bottom perspective bottom view of an embodiment of the outer container with a plurality of locking tabs in accordance with the present disclosure.
Figure 11:
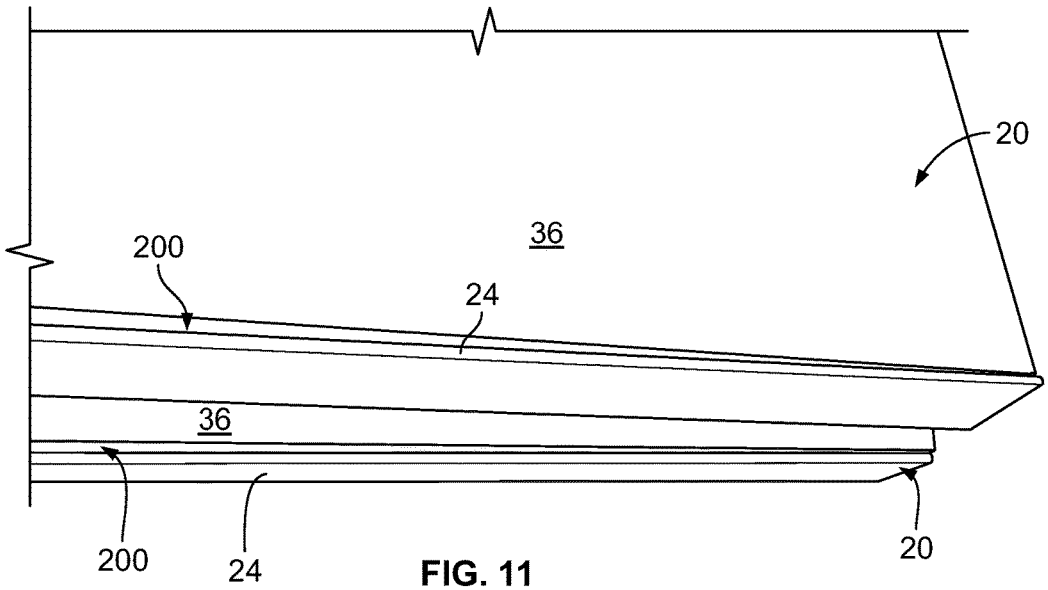
FIG. 11 is a perspective view of a pair of outer containers, one positioned above the other, in accordance with the present disclosure.
Figure 12:
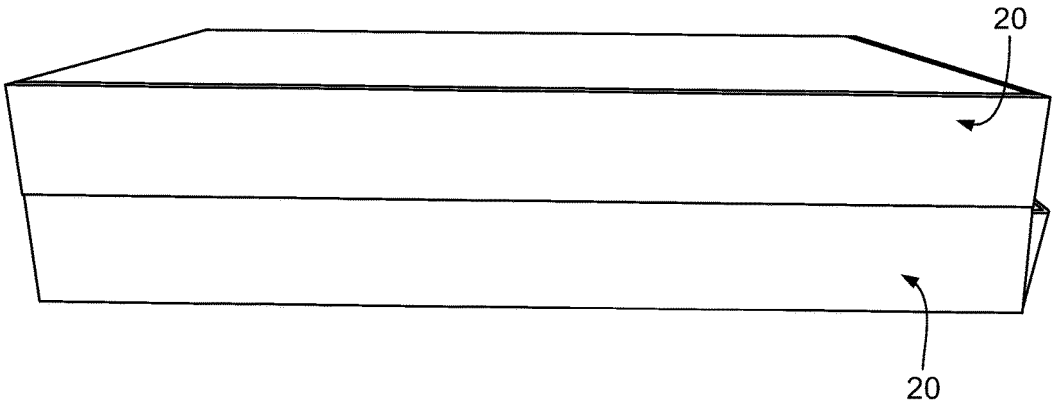
FIG. 12 is a side view of a pair of outer containers in a stack and interlocked arrangement in accordance with the present disclosure.

FIG. 10 shows the plurality of locking tabs 38 that may extend from the inner side wall panels 40, 42 of the outer container 20. The locking tabs 38 may extend downward through the slots 28 and be configured to conform within the slots 28 of the bottom panel 22. The locking tabs 38 may have a dimension that is greater than a thickness of said bottom panel 22 such that the locking tabs 38 project a distance through the bottom panel 22. When the outer container 20 is positioned in a stacked arrangement with another container, the locking tabs 38 may extend past the bottom panel 22 to at least partially engage an area 200 of the other stacked outer container 20. As illustrated by FIGS. 9 and 11, the area 200 may be the space between the top panel 36 and the side walls 24, 26 when the top panel is in the closed position. The locking tabs 38 may be adapted to fit into the area 200 of a similar and sub-adjacent container 20 for restraining the outer container 20 against relative movement as illustrated by FIG. 12. In the instance that the locking tabs 38 and outer container 20 is not in a stacked arrangement with a sub-adjacent outer container 20, the locking tabs 38 may function as feet to support the outer container 20 on any surface for support thereof.

In other embodiments of the present disclosure, the top panel 36 may further include at least one extension/locking tab or a flap thereon configured to interlock with the bottom panel 22 of a stacked container thereon. The flap may be configured to tuck into the sub-adjacent container. Additionally, the outer container 20 may further include pallet stacking loner along the bottom panel 22 or strips of adhesive along the bottom panel 22. Further, in another embodiment, the locking tabs 38 may be positioned adjacent the end wall 34 of the outer container 20 to abut against the end wall 34 of the sub-adjacent container to prevent further relative movement thereof.

This arrangement may allow the outer container 20 and inner container 120 to function as a stackable container apparatus that is easily shippable with a drawer and stacking feature for easy storage and material retrieval.

Figure 15:
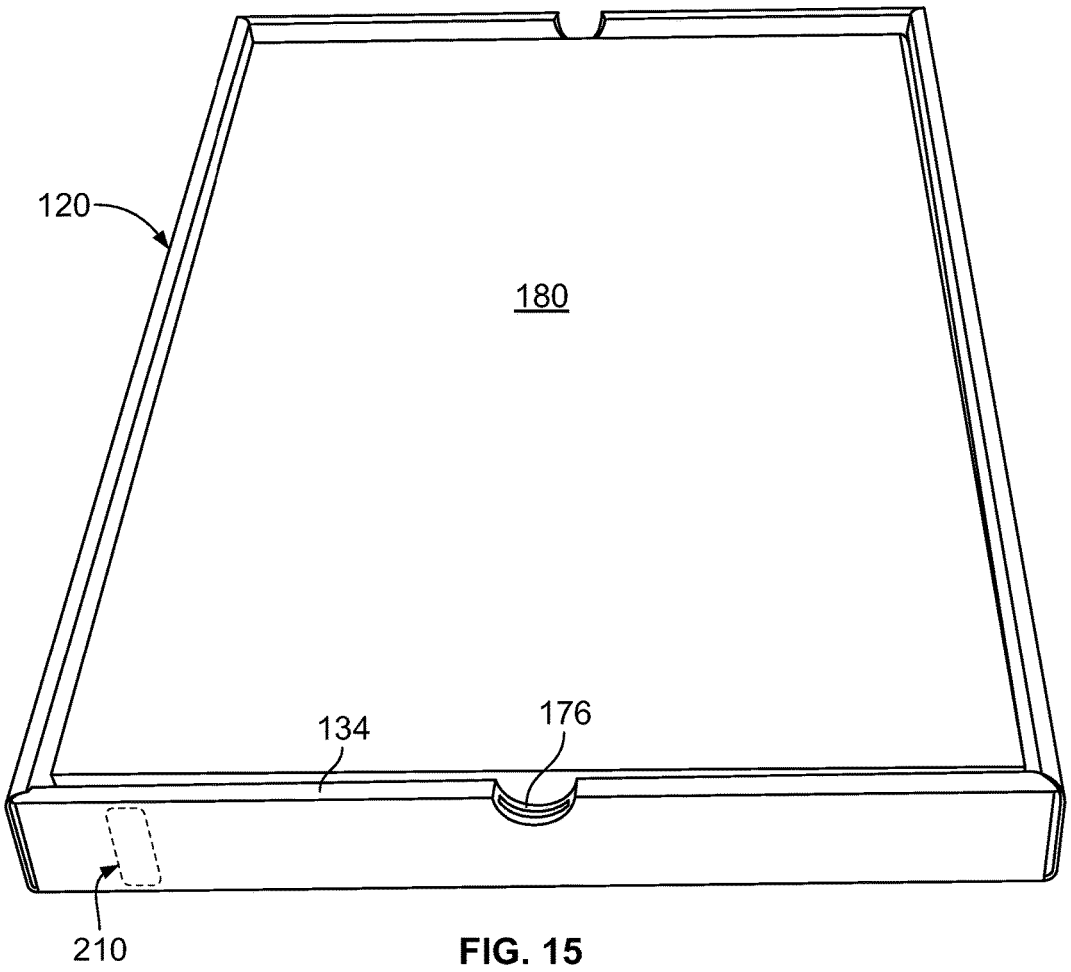
FIG. 15 is a front perspective view of the inner container having a see through hole in accordance with embodiments of the present disclosure.

FIG. 15 is an embodiment of the inner container 120 having a see through aperture 210 in accordance with embodiments of the present disclosure. The aperture 210 may function as a level indicator to allow the user to identify the amount of remaining media is retained within the inner container 120 without having to slide it outwardly from the outer container 20. Additionally, the aperture 210 may include a flap of material therein (i.e., a peek-a-boo hole) to allow a user to move the flap of material for use as a level indicator or to be able to grasp the inner container 120 for movement. The flap of material (not shown) may prevent dust from entering the inner container 120 and may be attached to an upper, lower or side of the aperture 210. In one embodiment, the stack of media may include a colored band or indicator that would correlate with an amount of media within the stack that would further let the user know an exact number of media remaining within the inner container 120 without having to remove the inner container 120 from the outer container 20.

Although the embodiments of the present disclosure have been illustrated in the accompanying drawings and described in the foregoing detailed description, it is to be understood that the present disclosure is not to be limited to just the embodiments disclosed, but that the disclosure described herein is capable of numerous rearrangements, modifications and substitutions without departing from the scope of the claims hereafter. The claims as follows are intended to include all modifications and alterations insofar as they come within the scope of the claims or the equivalent thereof.

I claim:

1. A stackable container, comprising:

an outer container comprising:

a bottom panel, a pair of opposite side walls and an end wall that extend from the bottom panel respectively, the side walls each include an outer side wall panel and an inner side wall panel, the inner side wall panels are attached along an upper edge of the outer side wall panel, the bottom panel having at least one slot extending therethrough approximately positioned by a plane of the inner side wall panel;

a plurality of locking tabs extend from a lower edge of the inner end wall panels, the locking tabs adapted to extend through the slots and approximately conform to the slots;

a top panel extends from an upper edge of the end wall, a pair of side flap panels extend from opposite edges of the top panel wherein the top panel is adapted to be pivoted between an open position and a closed position such that the side flap panels are positioned inwardly relative to the pair of opposite side walls in the closed position;

a front panel extends from the bottom panel and includes a pair of hinge flaps that extend from opposite edges of the front panel wherein the front panel is adapted to be pivoted between an open position and a closed position; and an inner container slidingly received within the outer container when the front panel is in the open position and when the top panel is in the closed position;

wherein the inner container further comprises:

a bottom panel, a pair of opposite side walls and a pair of opposite end walls that extend from the bottom panel respectively, the side walls and end walls each include an outer panel and an inner panel, the inner panels attached along an upper edge of the outer panel, the bottom panel having slots extending therethrough approximately positioned by, the planes of the inner side wall panels and the inner end wall panels;

a plurality of locking tabs approximately conforming to the slots extend from a lower edge of the inner side wall panels and at lower edges of the inner end wall panels, the locking tabs extending through the slots.

2. The stackable container of claim 1 wherein the inner container is configured to retain at least one article therein as the inner container is slidingly received within the outer container.

3. The stackable container of claim 2 wherein the at least one article is a printable media.

4. The stackable container of claim 1 wherein the pair of side flap panels are positioned between the inner side wall panel and the outer side wall panel of the outer container when the front panel is in the closed position.

5. The stackable container of claim 1 wherein the locking tabs have a dimension that is greater than a thickness of the bottom panel such that the locking tabs project a distance through the bottom panel, such that once the stackable container is positioned above a sub-adjacent stackable container, the locking tabs are adapted to fit into an area for assisting to restrain the outer container against relative movement.

6. The stackable container of claim 5, wherein the area for assisting to restrain the outer container against relative movement is a space between the top panel and the side walls when the top panel is in the closed position.

7. The stackable container of claim 1 wherein the outer container is formed from a one piece blank of foldable sheet material.

8. The stackable container of claim 1 wherein the inner container is formed from a one piece blank of foldable sheet material.

9. The stackable container of claim 1 wherein the outer container further comprises a font flap that extends from the top panel.

10. The stackable container of claim 9 wherein the outer container further comprises at least one double-locking tab.

11. The stackable container of claim 1 wherein the at least one slot is positioned along the plane of the inner side wall panel along the bottom panel and is in an offset parallel alignment with a side flap panel that extends from an edge of the top panel.

12. A stackable container, comprising:

an outer container comprising:

a bottom panel;

a pair of opposite side walls;

a plurality of locking tabs;

a top panel operably attached to the bottom panel wherein the top panel is adapted to be pivoted between an open position and a closed position;

a front panel adapted to be pivoted between an open position and a closed position; and an inner container selectively received within the outer container when the front panel is in the open position and when the top panel is in the closed position;

wherein the locking tabs have a dimension that is greater than a thickness of the bottom panel such that the locking tabs project a distance through the bottom panel, the locking tabs are adapted to fit into an area of a similar stackable container to restrain the outer container against relative movement between the outer container and the similar stackable container;

wherein the area for assisting to restrain the outer container against relative movement is a space between the top panel and the side walls when the top panel of the similar stackable container is in the closed position; and wherein at least one locking tab is positioned on a plane aligned with an inner side wall panel that is in offset parallel alignment with a side flap panel that extends from an edge of the top panel.

13. The stackable container of claim 12 wherein the bottom panel of the outer container further comprises:

an end wall that extends from the bottom panel;

the pair of opposite side walls each include an outer side wall panel and an inner side wall panel, the inner side wall panels are attached along an upper edge of the outer side wall panel, a plurality of slots are positioned by planes of the inner side wall panels; and the plurality of locking tabs extend from a lower edge of the inner end wall panels, the locking tabs are attached to the inner side wall panels and extend through the slots and approximately conform to the slots.

14. The stackable container of claim 13, wherein the top panel extends from an upper edge of the end wall and further includes:

a pair of side flap panels that extend from opposite edges of the top panel such that the side flap panels are positioned inwardly relative to the pair of opposite side walls in the closed position.

15. The stackable container of claim 14, wherein the front panel extends from the bottom panel and includes a pair of hinge flaps that extend from opposite edges of the front panel.

16. The stackable container of claim 12, wherein the inner container further comprises:

a bottom panel, a pair of opposite side walls and a pair of opposite end walls that extend from the bottom panel, the side walls and end walls each include an outer panel and an inner panel, the inner panels are attached along an upper edge of the outer panel, the bottom panel having slots extending therethrough approximately, positioned by the planes of the inner end wall panels and approximately positioned by the planes of inner side wall panels, respectively;

a plurality of locking tabs approximately conforming to the slots extend from lower edges of the inner end wall panels and at lower edges of the inner side wall panels, the locking tabs extending through the slots.

17. The stackable container of claim 12 wherein the outer container is formed from a one piece blank of foldable sheet material.

18. The stackable container of claim 12 wherein the inner container is formed from a one piece blank of foldable sheet material.

19. A stackable container, comprising:

an outer container comprising:

a bottom panel;

a pair of opposite side walls;

a plurality of locking tabs;

a top panel operably attached to the bottom panel wherein the top panel is adapted to be pivoted between an open position and a closed position;

a front panel adapted to be pivoted between an open position and a closed position; and an inner container comprises:

a bottom panel, a pair of opposite side walls and a pair of opposite end walls that extend from the bottom panel, the side walls and end walls each include an outer panel and an inner panel, the inner panels are attached along an upper edge of said outer panel, said bottom panel having slots extending therethrough approximately positioned by the planes of said inner end wall panels and approximately positioned by the planes of inner side wall panels, respectively;

a plurality of locking tabs approximately conforming to said slots extend from lower edges of said inner end wall panels and at lower edges of said inner side wall panels, the locking tabs extending through said slots;

said inner container slidingly received within the outer container when the front panel is in the open position.

* * * * *